US008257037B2

(12) United States Patent
Tildsley

(10) Patent No.: US 8,257,037 B2
(45) Date of Patent: Sep. 4, 2012

(54) NOZZLE GUIDE VANE ARRANGEMENT

(75) Inventor: Moira J. Tildsley, Derby (GB)

(73) Assignee: Rolls-Royce PLC, London (GB)

( * ) Notice: Subject to any disclaimer, the term of this patent is extended or adjusted under 35 U.S.C. 154(b) by 1298 days.

(21) Appl. No.: 12/000,650

(22) Filed: Dec. 14, 2007

(65) Prior Publication Data

US 2008/0166226 A1 Jul. 10, 2008

(30) Foreign Application Priority Data

Jan. 5, 2007 (GB) ..... 0700142.3

(51) Int. Cl.
*F03B 3/16* (2006.01)

(52) U.S. Cl. ..... 415/209.2; 415/209.3

(58) Field of Classification Search ..... 415/209.2, 415/209.3, 209.4, 213.1, 214.1, 189, 208.2
See application file for complete search history.

(56) References Cited

U.S. PATENT DOCUMENTS

| | | | | |
|---|---|---|---|---|
| 6,887,041 | B2 * | 5/2005 | Coke et al. | 415/191 |
| 2002/0122716 | A1 | 9/2002 | Beacock et al. | |
| 2006/0216140 | A1 | 9/2006 | Dervaux et al. | |
| 2006/0245912 | A1 | 11/2006 | Dervaux et al. | |

FOREIGN PATENT DOCUMENTS

| | | | |
|---|---|---|---|
| EP | 1 705 342 | A2 | 9/2006 |
| GB | 2 144 492 | A | 3/1985 |

* cited by examiner

*Primary Examiner* — Dwayne J White
(74) *Attorney, Agent, or Firm* — Oliff & Berridge, PLC

(57) ABSTRACT

A nozzle guide vane arrangement comprising a vane member having a platform portion extending forwards of a leading edge of the vane member, the platform portion having a first securing member and a second securing member to provide at least part of the means to retain the vane member in use, the arrangement characterized in that the first securing member and the second securing member are staggered with an axial displacement relative to each other upon the platform portion in the direction from the leading edge to a trailing edge of the vane member.

31 Claims, 4 Drawing Sheets

NOZZLE GUIDE VANE ARRANGEMENT

This invention relates to nozzle guide vane arrangements, and more particularly, but not exclusively, the invention relates to guide vane arrangements for use in a turbine, such as an intermediate pressure turbine of a gas turbine engine.

Nozzle guide vanes are provided to direct air on to the blades of a turbine. Each nozzle guide vane is fixed in position by securing members at the inner and outer regions. In some cases, particularly in the case of the intermediate pressure turbine of a three-shaft gas turbine engine, the nozzle guide vane is held in position by securing members at two axial positions on the outer platform. With known nozzle guide vanes, it has been found that the front outer platform of the vane moves in and out in a radial direction so that this has resulted in excessive leakage of gases over the high pressure blade, hence reducing the performance of the engine.

FIG. 4 shows a typical prior art vane member 230 for association within a vane arrangement. As can be seen, the vane member 230 incorporates a vane 100 with an outer platform 134 and an inner platform 36. The outer or upper platform 134 includes a platform portion 134A which extends forwards of a leading edge (not shown) of the vane aerofoil 100. The platform portion 134A includes a leading edge 142. The vane 230 is secured through forward securing members 146 and further rearward securing members 140 which engage suitable securing formations in a casing (not shown) to which the vane member 230 is secured. As can be seen, the securing members 146 in particular are circumferentially aligned in order to provide adequate support for the vane 230 and ease of manufacture. It will be understood that the securing members 146 engage as indicated parts of the casing such that a leading edge 142 utilized to provide a seal does not disengage or result in cracking of the vane member 230 in use due to high pressure and temperatures. In short the securing members 146 locate and secure the vane in association with other features. However, as indicated above, it has been found that the front edge 142 has been found to move up and down in a radial direction in use. Such up and down displacement will result in pivotal movement of the platform segment or portion 134A resulting in excessive leakage of hot gases and a reduction in overall performance of an engine incorporating a vane arrangement.

According to one aspect of the present invention there is provided a nozzle guide vane arrangement comprising a vane member having a platform portion extending forwards of a leading edge of a vane member, the platform portion having a first securing member and a second securing member to provide at least part of the means to retain the vane member in use, the arrangement characterised in that the first securing member and the second securing member are staggered with an axial displacement relative to each other upon the platform portion in the direction from the leading edge to a trailing edge of the vane member.

The first securing member may comprise a first hook member. The second securing member may comprise a second hook member.

Typically, the platform portion defines an upstream edge and the first securing member is located about the upstream edge. Generally, the platform portion is part of a platform member located upon the vane member and has a downstream edge upon which a rear securing member is located. Generally, the second and rear securing members are arranged to provide principal securing mountings for the vane member.

In one embodiment, the first and second securing members are configured to co-operatively engage corresponding securing formations in a casing. Generally, the rear securing member also engages a securing formation on the casing. The casing may extend radially outwardly of the nozzle guide vane arrangement.

Possibly, the nozzle guide vane arrangement incorporates a pair of securing members. The pair of securing members may be arranged adjacent to each other with a circumferential displacement between.

Possibly, the platform portion has a first corner and a second corner, the first corner and the second corner opposite each other. Generally, an upstream edge of the platform portion is between the first corner and the second corner.

Generally, the second securing member is arranged in a central region of the platform member. Generally, the rear securing member is arranged to balance securing load presented through the first securing member and the second securing member. Possibly, the second securing member is arranged adjacent a side edge of the platform member.

Possibly, the second securing member is offset circumferentially from the first securing member. Alternatively, the second securing member is aligned axially with the first securing member.

Possibly, the first securing member may extend circumferentially part way across the platform portion. The, or each, second securing member may extend circumferentially part way across the platform portion.

Further in accordance with aspects of the present invention there is provided a casing arrangement comprising a nozzle guide vane arrangement as described above and an outer casing to which the nozzle guide vane arrangement is secured.

The casing has a first securing formation thereon arranged to co-operate with the first securing member. The casing may have a second securing formation thereon arranged to co-operate with the second securing member. Typically, the first and the second securing formations extend radially inward of the outer casing.

Typically, the first securing formation is arranged upstream relative to the second securing formation within the casing. Generally, the first securing formation defines a recess to receive a portion of the first securing member. Typically, the first securing formation is annular to co-operate with respective first securing members of a plurality of circumferentially adjacent nozzle guide arrangements as described above. Alternatively, the first securing formation comprises a plurality of spaced first securing elements, each first securing element being arranged to co-operate with a first securing member of a respective one of circumferentially adjacent nozzle guide arrangements as described above.

Typically, the casing includes rear securing formations arranged to co-operate with the rear securing member on the platform.

Typically, the second securing formation defines a recess to receive them, or each, second securing member. Possibly, the second securing formation is annular to co-operate with the, or each, second securing member of a plurality of circumferentially adjacent nozzle guide vane arrangements as described above.

An embodiment of the invention will now be described by way of example only, with reference to the accompanying drawings, in which.

Figure 1:
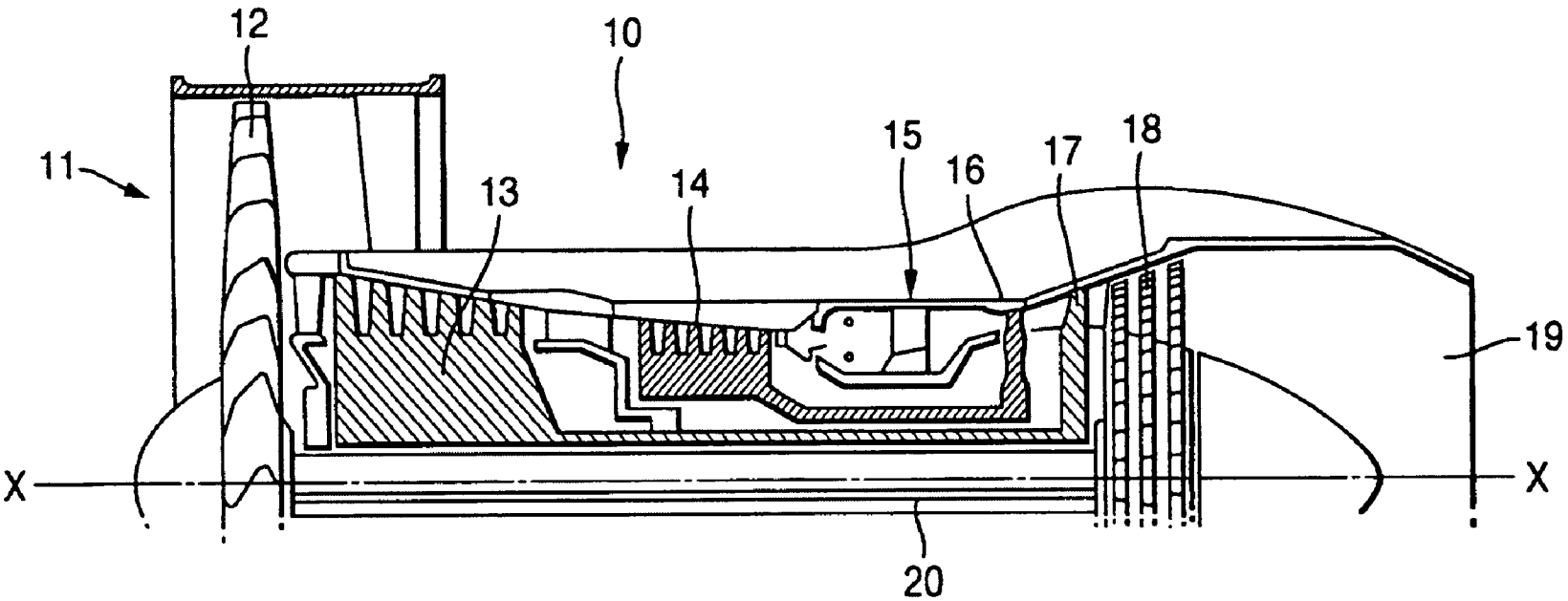
FIG. 1 is a diagrammatic sectional view of an upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
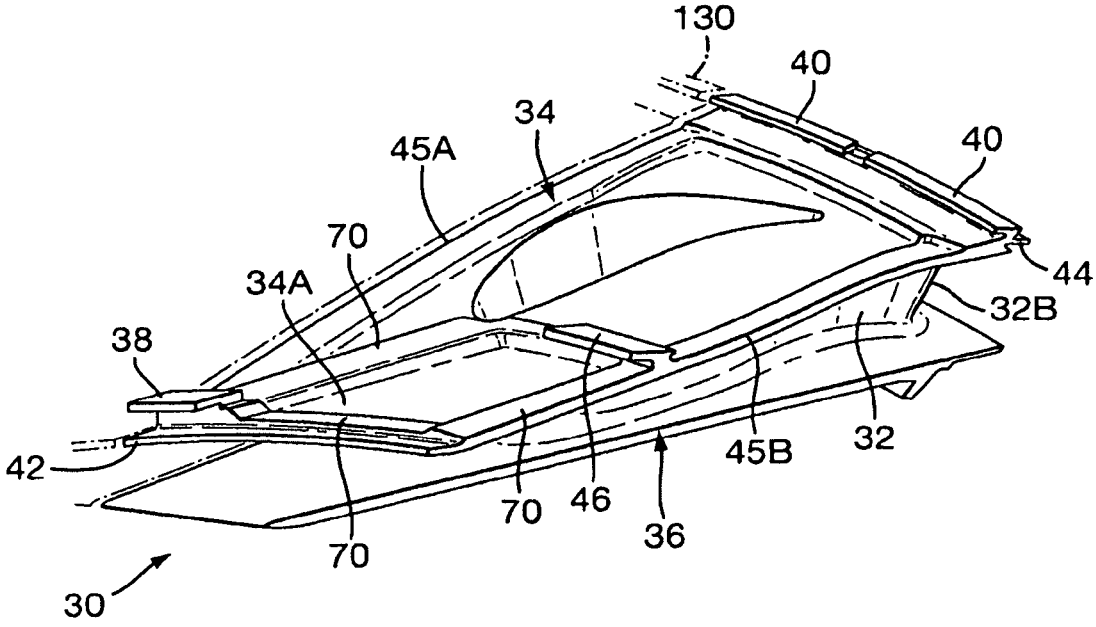
FIG. 2 is a perspective view of a nozzle guide vane arrangement.
Figure 3:
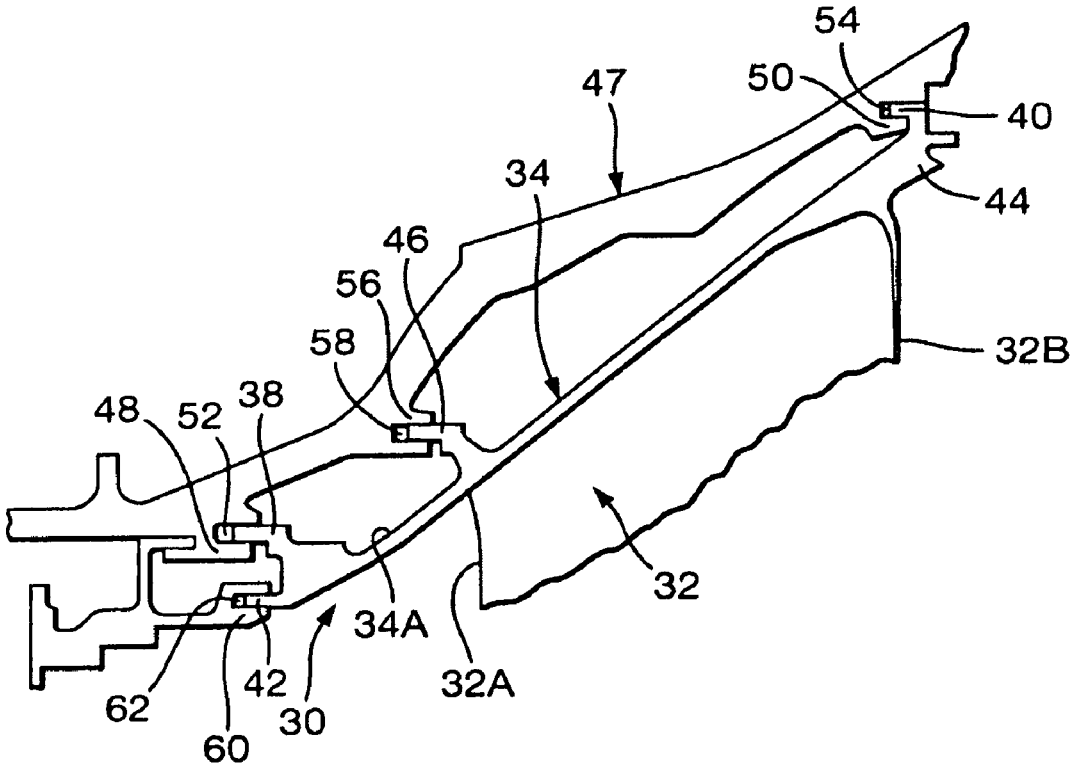
FIG. 3 is a side view of the radially outer platform of a nozzle guide vane arrangement shown in FIG. 1 attached to a casing.

Referring to the FIGS. 2 and 3, there is shown a nozzle guide vane member 30 provided to direct the combusted gases to the turbine blades of the high intermediate and/or low pressure turbines 16, 17, 18 of the gas turbine engine 10. In the embodiment shown, the nozzle guide vane member 30 is provided in the intermediate pressure turbine 17 and will be associated with a casing as described later.

The nozzle guide vane member 30 comprises a nozzle guide vane 32 having a leading edge 32A and a trailing edge 32B mounted thereon a radially outer platform 34 and a radially inner platform 36. The outer platform 34 includes a platform portion 34A which extends forwards of the leading edge 32A. The platform portion 34A includes a first securing member 38 and a second securing member 46. The vane member 30 is principally secured by the second securing member 46 and rear securing members 40 towards the trailing edge 32B of the platform member 34.

The first and second securing members 38, 46, are in the form respectively of first and second hooks members arranged to, as indicated, at least contribute to securing the vane member 30.

The radially outer platform 34 extends forwardly of the leading edge 32A at a forward region to define the platform portion 34A. The first securing member 38 is provided forwardly of the leading edge 32A of the vane member 32 at an upstream edge 42 of the radially outer platform member 34. The rear securing members 40 are provided at a downstream edge 44 of the radially outer platform 34. As can be seen, there are two rear securing members 40 arranged circumferentially side by side on the radially outer platform 34 to co-operate with the second securing members 46 at least to secure the vane member 30.

Opposite side edges 45A, 45B extend between the upstream and downstream edges (42, 44). The first securing member 38 is provided about the corner defined by the upstream edge 42 and the first side edge 45A.

The second securing member 46 is arranged substantially mid-way between the first and rear securing members 38, 40 and, as indicated, is in the form of a hook member.

FIG. 2 also shows, in broken lines, a further nozzle guide vane arrangement 130, adjacent the nozzle guide vane arrangement 30, to represent a plurality of nozzle guide vane arrangements disposed circumferentially around the engine to provide an annular array of nozzle guide vane arrangements. Only two nozzle guide vane arrangements are shown for clarity.

A casing 47 extends around the array of nozzle guide vane arrangements and includes either a plurality of securing formations 48, 50, 56 arranged one after the other circumferentially around the casing 47. Alternatively, the securing formations 48, 50, 56 can be annular in configuration, extending wholly around the casing 47.

FIG. 3 shows a sectional side view of a casing 47 provided radially outwardly of the nozzle guide vane arrangement 30. The casing 47 comprises first and rear securing formations 48, 50. The first securing formation 48 is provided upstream of the rear securing formation 50. The first securing formation 48 defines a recess 52 to receive the first securing member 38. As can be seen, the first securing formation 48 is provided in the vicinity of the upstream edge 42 of the radially outer platform portion 34A.

The rear securing formation 50 defines a recess 54 to receive the rear securing member 40 and is provided in the vicinity of the downstream edge 44 of the radially outer platform member 34.

In addition to the first and rear securing formations 48, 50, there is also provided a second securing formation 56 arranged between the first and further securing formations 48, 50. The second securing formation 56 defines a recess 58 to receive the second securing member 46.

An additional securing formation 60 is provided in the vicinity of the first securing formation 48 and defines a recess 62 to receive the upstream edge 42 of the radially outer platform member 34.

Thus, the radially outer platform member 34 is held at the first, second and rear securing members 38, 46, 40 and at the upstream edge 42 by first, second, rear and additional securing formations 48, 56, 50, 60 respectively. By providing securing formations at the upstream and downstream edges of the outer platform portion 32A, the above described embodiment has the advantage that movement of the forward region or platform portion 34A of the radially outer platform 34 is prevented or mitigated. This reduces excessive leakage of gases over the tips of the high pressure turbine blades. Thus, there is an improvement in performance of the gas turbine engine 10.

Various modifications can be made without departing from the scope of the invention. For example, the first and second securing members 38, 46 could be circumferentially aligned with one another, either with the first securing member 38 in the position shown in FIG. 2 and the second securing member 46 moved across, or the second securing member 46 being in the position shown in FIG. 2 and the second securing member 38 moved across to be in alignment therewith.

As indicated above, generally in the embodiment of the invention described above, the vane member 30 will be secured through the second securing member 46 and rear securing member 40 within the casing 47. However, it is by positioning and the relationship between the first securing member 38 and the second securing member 46 along with associated securing formations 48, 58 in the casing 47 which provides retention to reduce excessive leakage and problems associated with pivoting and excessive displacement of the front of the platform portion 34A in use. Aspects of the present invention provide an intermediate support feature between the first securing member 38 and the rear securing member 40. This intermediate support feature is the second securing member 46. Aspects of the present invention therefore provide, as indicated, a platform portion 34A which extends forwards of the leading edge 32A to present the first securing member 38. This elongates the mounting range and inhibits distortion and pivot in the platform 34. Clearly, with regard to gas turbine engines stresses and strains on the vane member as well as excessive weight can be significant factors. In such circumstances to obtain best performance the first securing member 38 and second securing member 46 are staggered, that is to say both circumferentially and axially displaced relative to each other in the direction of the vane member 30. As indicated above, previously it was known to provide two securing members e.g. 46 at an intermediate position. These securing members were circumferentially displaced relative to each other but not axially displaced relative to each other and therefore allowed the front platform portion tilt.

Figure 4:
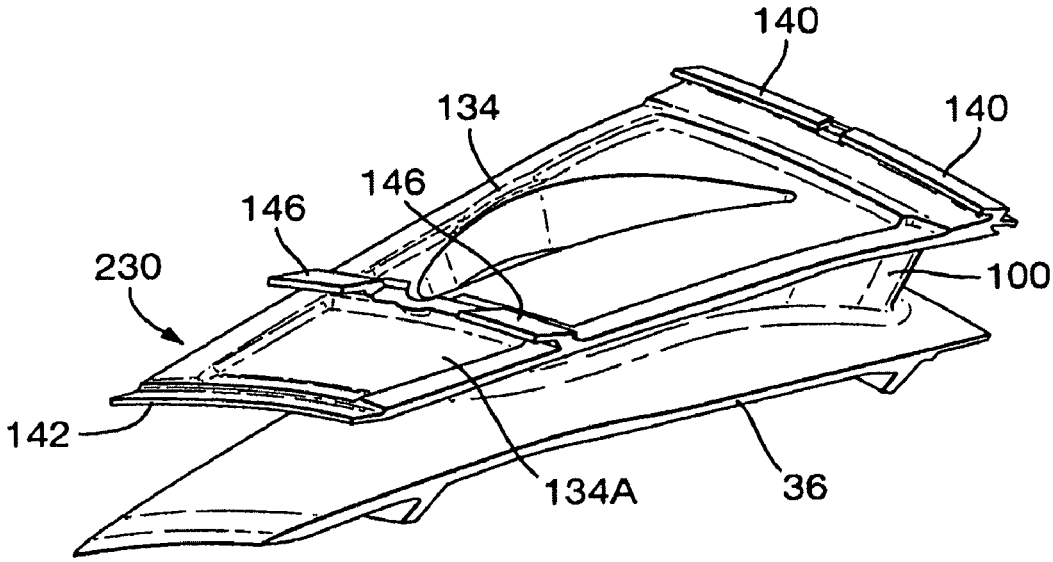
Fig.4. Prior Art
FIG. 4 is an example of a prior art vane arrangement.

As indicated above, in FIG. 4, it is known to provide securing members 146 and rear securing members 140 to locate a vane member 230 relative to a casing (not shown). A leading edge 142 of the platform 134 is generally supported with an additional securing formation as in 60 in FIG. 3. In accordance with aspects of the present invention a securing member is located about this leading edge 142 in the platform portion 134A. Thus, displacement about the edge 142 is reduced In accordance with aspects of the present invention it will be appreciated that, as depicted in FIG. 4, the securing members 146 are equivalent to the second securing members 46 in accordance with aspects of the present invention as described above. In FIG. 4, it will be noted there are two securing members 146, such an approach may also be taken with regard to aspects of the present invention but it will be understood that provision of two securing members 146 may be excessive in view of the loadings presented to the vane 230 and therefore it is generally preferable in order to reduce weight and stressing on the vane 230 to provide staggering between the first securing member 38 and second securing member 46 as depicted in FIG. 2. Such an approach achieves positive presentation of a vane 30 in use but without the extra weight of a further hook member at the intermediate second securing member 46 position. Generally, most loading with regard to the vane member 30 may still be presented through the second securing member 46 equivalent to securing members 146 in FIG. 4 and the further securing members 40

The leading edge 142 is further supported in accordance with aspects of the present invention to avoid excessive displacement through use of strengthening rails 70 extending across the platform portion 34A from the leading edge 42 to the first securing member 38. By providing a robust presentation of the leading edge 32A it will be appreciated, as indicated above, that radial displacement of the vane about this edge is maintained at existing or improved levels in comparison with prior arrangements. The strengthening rails 70 generally stop the vane leading edge from dropping and putting excessive strain on the hook at the front.

It will be understood that the securing members in accordance with aspects of the present invention are preferably hooks with one located forward of the other and generally in a staggered relationship. The distances either axial or circumferential will depend upon desired operational performance, materials used and other features of the platform and vane member. It will also be understood that the stagger between the first securing member 38 and second securing member 46 may be inverted in comparison with that depicted in the Figures so that the first securing member 38 is on the near side of the leading edge 42 with the second securing member 46 displaced towards the other side.

The invention claimed is:

1. A nozzle guide vane arrangement comprising:

a vane member having a platform and a nozzle guide vane mounted on the platform, the nozzle guide vane having a leading edge, the platform including a platform portion extending forward of the leading edge, the platform portion having a first securing member and a second securing member to at least partially retain the vane member in use, the first securing member and the second securing member being staggered with an axial displacement relative to each other upon the platform portion in the direction from the leading edge to a trailing edge of the vane member.

2. The arrangement as claimed in claim 1, wherein the first securing member comprises a first hook member.

3. The arrangement as claimed in claim 1, wherein the second securing member comprises a second hook member.

4. The arrangement as claimed in claim 1, wherein the platform portion defines an upstream edge and the first securing member is located about the upstream edge.

5. The arrangement as claimed in claim 1, wherein the platform portion is part of a platform member located upon the vane member and has a downstream edge upon which a rear securing member is located.

6. The arrangement as claimed in claim 5, wherein the second and rear securing members are arranged to provide principal securing mountings for the vane member.

7. The arrangement as claimed in claim 5, wherein the rear securing member also engages a securing formation on the casing.

8. The arrangement as claimed in claim 5, wherein the second securing member is arranged in a central region of the platform member.

9. The arrangement as claimed in claim 5, wherein the rear securing member is arranged to balance securing load presented through the first securing member and the second securing member.

10. The arrangement as claimed in claim 5, wherein the second or rear securing member is arranged adjacent a side edge of the platform member.

11. The arrangement as claimed in claim 5, wherein the rear securing member may extend circumferentially part way across the platform member.

12. The arrangement as claimed in claim 1, wherein the first and second securing members are configured to co-operatively engage corresponding securing formations in a casing.

13. The arrangement as claimed in claim 1, wherein a casing extends radially outwardly of the nozzle guide vane arrangement.

14. The arrangement as claimed in claim 1, wherein the nozzle guide vane arrangement incorporates a plurality of vane members.

15. The arrangement as claimed in claim 14, wherein the plurality of vane members may be arranged adjacent to each other with a circumferential displacement between.

16. The arrangement as claimed in claim 1, wherein the platform portion has a first corner and a second corner, the first corner and the second corner being opposite each other, wherein the upstream edge of the platform portion is between the first corner and the second corner.

17. The arrangement as claimed in claim 1, wherein the second securing member is offset circumferentially from the first securing member.

18. The arrangement as claimed in claim 1, wherein the, or each, second securing member may extend circumferentially part way across the platform portion.

19. A casing arrangement comprising a nozzle guide vane arrangement as claimed in claim 1, and an outer casing to which the nozzle guide vane arrangement is secured.

20. The casing arrangement as claimed in claim 19, wherein the casing has a first securing formation arranged to co-operate with the first securing member and a second securing formation arranged to co-operate with the second securing member.

21. The casing arrangement as claimed in claim 20, wherein the first and the second securing formations extend radially inward of the outer casing.

22. The casing arrangement as claimed in claim 20, wherein the first securing formation is arranged upstream relative to the second securing formation within the casing.

23. The casing arrangement as claimed in claim 20, wherein the first securing formation defines a recess to receive a portion of the first securing member and the second securing formation defines a recess to receive the second securing member.

24. The casing arrangement as claimed in claim 20, wherein the first securing formation is annular to co-operate with respective first securing members of a plurality of circumferentially adjacent nozzle guide vane arrangements.

25. The casing arrangement as claimed in claim 20, wherein the first securing formation comprises a plurality of spaced first securing elements, each first securing element being arranged to co-operate with a first securing member of a respective one of circumferentially adjacent nozzle guide arrangements.

26. The casing arrangement as claimed in claim 20, further including additional securing members, wherein the casing includes additional securing formations arranged to co-operate with the additional securing members on the platform.

27. The casing arrangement as claimed in claim 20, wherein the second securing formation is annular to co-operate with the, or each, second securing member of a plurality of circumferentially adjacent nozzle guide vane arrangements.

28. A gas turbine engine incorporating a nozzle guide vane arrangement as claimed in claim 1.

29. A nozzle guide vane arrangement, comprising:

a vane member having a platform and a nozzle guide vane mounted on the platform, the nozzle guide vane having a leading edge, the platform including a platform portion extending forward of the leading edge, the platform portion having a first securing member and a second securing member to at least partially retain the vane member in use, the first securing member and the second securing member being staggered with an axial displacement relative to each other upon the platform portion in the direction from the leading edge to a trailing edge of the vane member, wherein the platform portion has a first corner and a second corner, the first corner and the second corner being opposite each other, wherein the upstream edge of the platform portion is between the first corner and the second corner.

30. A nozzle guide vane arrangement, comprising:

a vane member having a platform and a nozzle guide vane mounted on the platform, the nozzle guide vane having a leading edge, the platform including a platform portion extending forward of the leading edge, the platform portion having a first securing member and a second securing member to at least partially retain the vane member in use, the first securing member and the second securing member being staggered with an axial displacement relative to each other upon the platform portion in the direction from the leading edge to a trailing edge of the vane member, wherein the second securing member is offset circumferentially from the first securing member.

31. The arrangement as claimed in claim 1, wherein the platform portion comprises at least one strengthening rail extending across the platform portion from the leading edge to the first securing member.

* * * * *